US005950680A

United States Patent [19]

Randall

[11] Patent Number: 5,950,680

[45] Date of Patent: Sep. 14, 1999

[54] CONCRETE REINFORCING BAR IMPALEMENT PROTECTION DEVICE

[76] Inventor: Robert F. Randall, 380 NW. 181 St. Ave., Beaverton, Oreg. 97006

[21] Appl. No.: 09/072,748

[22] Filed: May 5, 1998

[51] Int. Cl.[6] ..... B65D 59/06; E04H 17/14

[52] U.S. Cl. ..... 138/96 R; 138/177; 52/301; 256/59

[58] Field of Search ..... 138/96 R, 96 T, 138/110, 103, 177, 178, DIG. 11; 52/301, 300; 256/59, 65

[56] References Cited

U.S. PATENT DOCUMENTS

| | | | |
|---|---|---|---|
| D. 262,093 | 12/1981 | Bush et al. | D8/386 |
| 2,379,529 | 7/1945 | Kennedy | 138/96 R X |
| 2,573,552 | 10/1951 | Detzel | 138/96 R X |
| 2,873,765 | 2/1959 | Gregory | 138/96 |
| 3,058,472 | 10/1962 | Thornton, Jr. | 138/96 R X |
| 3,104,681 | 9/1963 | Gray, Jr. | 138/96 |
| 3,160,175 | 12/1964 | Laemmle | 138/96 |
| 3,350,044 | 10/1967 | Zulauf | 138/96 R X |
| 3,420,275 | 1/1969 | Glen et al. | 138/96 R |
| 4,095,810 | 6/1978 | Kulle | 138/96 R |
| 4,202,378 | 5/1980 | Bush et al. | 138/96 |
| 4,203,474 | 5/1980 | Lequeux et al. | 138/96 R |
| 4,777,985 | 10/1988 | Arduini et al. | 138/96 R |
| 5,200,240 | 4/1993 | Baker | 428/34.1 |
| 5,447,290 | 9/1995 | Workman | 256/59 |
| 5,503,189 | 4/1996 | Lamendola | 138/96 R |
| 5,522,472 | 6/1996 | Shuman, Jr. et al. | 182/3 |
| 5,826,398 | 10/1998 | Carnicle | 52/301 X |

FOREIGN PATENT DOCUMENTS

| | | | |
|---|---|---|---|
| 247469 | 10/1960 | Australia | 138/96 R |

*Primary Examiner*—Patrick Brinson
*Attorney, Agent, or Firm*—John D. Gugliotta

[57] ABSTRACT

Disclosed is an impalement protector for use in shielding protruding concrete reinforcing bars, typically found on construction sites, used to prevent personal injuries caused by falling or otherwise coming into contact with the tip thereof. It consists of an elongated U-shaped channel that is formed such that the free ends thereof are drawn together such that the impalement protector slides over the reinforcing bars, creating a friction fit therewith and securing itself thereto.

4 Claims, 5 Drawing Sheets

CONCRETE REINFORCING BAR IMPALEMENT PROTECTION DEVICE

BACKGROUND OF THE INVENTION

1. Field of the Invention

The present invention relates generally to devices that aid in the protection of construction workers on job sites, and more specifically to a protective shielding device used to protect workers from impalement, should they fall onto or otherwise come into contact with exposed and protruding concrete reinforcing bars. The protective shield is elongated and rectangular in nature so as to allow shielding of a plurality of linearly aligned reinforcing bars rather than conventional cap-like shields that cover a single bar.

2. Description of the Related Art

Safety in the workplace is among the highest of employer priorities and among the largest areas of employee concern. Accordingly, legislation is continually being defined and put in place in order to improve workplace safety and reduce the amount of worker injuries. These regulations, enacted by the Occupational Safety and Health Administration (OSHA), apply to virtually all working scenarios, regardless of to what extent they relate to the actual work being done. However, in the area of construction, these regulations relate heavily and are strictly enforced. Among these construction type regulations, it is quite often a requirement that any concrete reinforcing bars that typically protrude from structures under construction be covered by a protective device in order to prevent the workers from being injured thereby.

Previously designed cap-type protectors consist of a cylindrical cap with securing flutes constructed along the inner wall thereof that create a friction fit when placed upon the reinforcement bars. The surface of the cap consists of a large rectangular flat surface that protects the worker from impalement by spreading the impact force created by a fall over its large surface area. While these devices have proven to be effective in protecting workers from impalement when used in the proper manner, they suffer from several basic drawbacks. First, these protection caps cover only a single reinforcement bar at a time, making the installation and removal of the device overly burdensome and time-consuming. Second, storage and transportation of these devices is unnecessarily difficult due to the shape and size of the cap which cannot be stacked or otherwise arranged in a uniform manner without the use of some sort of container or the like. Third, after extended use, the friction securing means incorporated in these devices tends to wear out, causing the cap to become loose, creating the possibility that they can be blown or otherwise knocked off the reinforcing bars. Finally, the use of single caps allows hoses, lines, electrical cords, etc. to fall in between the protruding reinforcing bars, becoming entangled therein and causing unnecessary burdens.

In the ancillary art, there are several related devices that are intended to perform a variety of functions ranging from providing job-site construction worker protection to providing material protection for pipes, conduits and the like.

U.S. Pat. No. 4,202,378 and Des. Pat. No. 262,093, both issued in the name of Bush et al., disclose rebar safety caps for placement over the ends of protruding concrete reinforcement bars in order to protect workers from injuries associated with falling onto or otherwise coming into contact therewith. The caps consist of a cylindrical sleeve that forms a friction fit with the reinforcement bars when placed thereon. The sleeve is topped with a large rectangular flat surface that protects the worker from impalement by spreading the impact force created by a fall over the large surface area. While the purpose of this invention is similar in nature to that of the present invention, it suffers from several drawbacks to which the present invention is aimed and successfully overcomes. First, the Bush et al. protection cap covers only a single reinforcement bar at a time, making the installation and removal of the device overly burdensome and time-consuming. Second, storage and transportation of these devices is unnecessarily difficult due to the shape and size of the cap which cannot be stacked or otherwise arranged without the use of some sort of container or the like. Finally, after extended use, the friction securing means incorporated in these devices tends to wear out, causing the cap to become loose, creating the possibility that they can be blown or otherwise knocked off the reinforcing bars.

U.S. Pat. No. 5,522,472, issued in the name of Shuman, Jr. et al, discloses a fall protection system for bridge construction in which an overhead harnessing system prevents the workers from falling and possibly becoming impaled on protruding reinforcing bars and the like. While this invention does serve to protect construction workers and the like from the same type of impalement injuries as that of the present invention, notwithstanding the obvious differences, it insufficient for several reasons. First, in many cases where safety harnesses have been used in the past, it is well known that workers tend to lapse in their safety awareness and either forget or neglect to use their harness. Second, even on sites where the harnesses are used, their are certain situations where the worker is necessarily unharnessed, for example when entering, leaving or crossing between zones where harness use is required. Finally, use of the harness does not relieve these employers or contractors of the need to comply with both federal and state safety requirements and guidelines that mandate the use of reinforcement bar protection means.

Several patents disclose protective caps for covering the ends of pipes, tubes, bars and the like whose purpose is to protect the material from damage as a result of coming into contact with other surfaces:

U.S. Pat. No. 5,503,189, issued in the name of Lamendola.

U.S. Pat. No. 4,777,985, issued in the name of Arduini et al.

U.S. Pat. No. 4,203,474, issued in the name of Lequeux et al.

U.S. Pat. No. 3,160,175, issued in the name of Laemmle.

U.S. Pat. No. 3,104,681, issued in the name of Gray, Jr.

U.S. Pat. No. 2,873,765, issued in the name of Gregory.

These devices are intended to protect delicate materials such as pipe threads, pipe junctions and thin-walled conduits from damage in transportation or during construction. These devices are not intended to, nor do they provide, adequate worker protection from impalement should they fall onto them. Furthermore, it is unclear as to whether these devices even provide scratching or cut protection should one merely brush up against or otherwise come into light contact therewith.

While several features exhibited within these references are incorporated into this invention, alone and in combination with other elements, the present invention is sufficiently different so as to make it distinguishable over the prior art. Consequently, a need has been felt for a means by which construction and other workers at construction sites can be protected from impalement on protruding concrete reinforcing bars should they fall on or otherwise come into contact therewith.

SUMMARY OF THE INVENTION

The present invention solves the aforementioned problems by providing a cover in which each unit protects a multitude of bars. Rather than a cap-type cover, the protection device consists of an elongated sleeve with a rectangular profile, usually in six foot lengths or longer, that can accommodate any number of reinforcement bars lying along its length. It consists of a U-shaped channel, constructed of a single piece of extruded plastic, molded plastic or folded sheet metal, that is formed such that the free ends thereof converge together due to the degree to which the resilient material is folded along the closed edge. As a result, the protection device slides over the reinforcing bars, creating a friction fit therewith and securing itself thereto. The present invention is easy to store and transport due to its overall shape that lends well to arranging in stacks upon a flat surface.

Accordingly, it is an object of the present invention to provide a concrete reinforcing bar impalement protection device that will protect construction workers and others on construction sites from becoming impaled upon the reinforcing bars due to falling or otherwise coming into contact therewith.

It is another object of the present invention to provide a concrete reinforcing bar impalement protection device that will shield one or more plurality of protruding reinforcing bars, all of which are in linear alignment with one another.

It is another object of the present invention to provide a concrete reinforcing bar impalement protection device whose design is such that it is easily installed and removed.

It is another object of the present invention to provide a concrete reinforcing bar impalement protection device that consists of a single-element design, thus minimizing production and material costs associated with the manufacture thereof.

It is another object of the present invention to provide a concrete reinforcing bar impalement protection device that is lightweight, durable and can be reused on a multitude of projects.

It is another object of the present invention to provide a concrete reinforcing bar impalement protection device whose construction is such that the resilient nature of the material creates a spring biasing that creates a clamping force that produces a friction fit with the reinforcing bars, preventing the protection device from being blown or otherwise knocked off.

Finally, it is an object of the present invention to provide a concrete reinforcing bar impalement protection device that is of a uniform design and construction, creating the ability to be easily gathered and stacked upon one another for storage and transportation purposes.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

10 Concrete Reinforcing Bar Impalement Protection Device
11 Inserting Edge
12 Receiving Edge
13 Protector Sidewalls
15 Bar-Guiding Flanges
17 Bar securing Surfaces
20 Concrete Reinforcing Bars
21 Annular Ridges
A Acute Angle A

DESCRIPTION OF THE PREFERRED EMBODIMENTS

1. Detailed Description of the Figures

Figure 1:
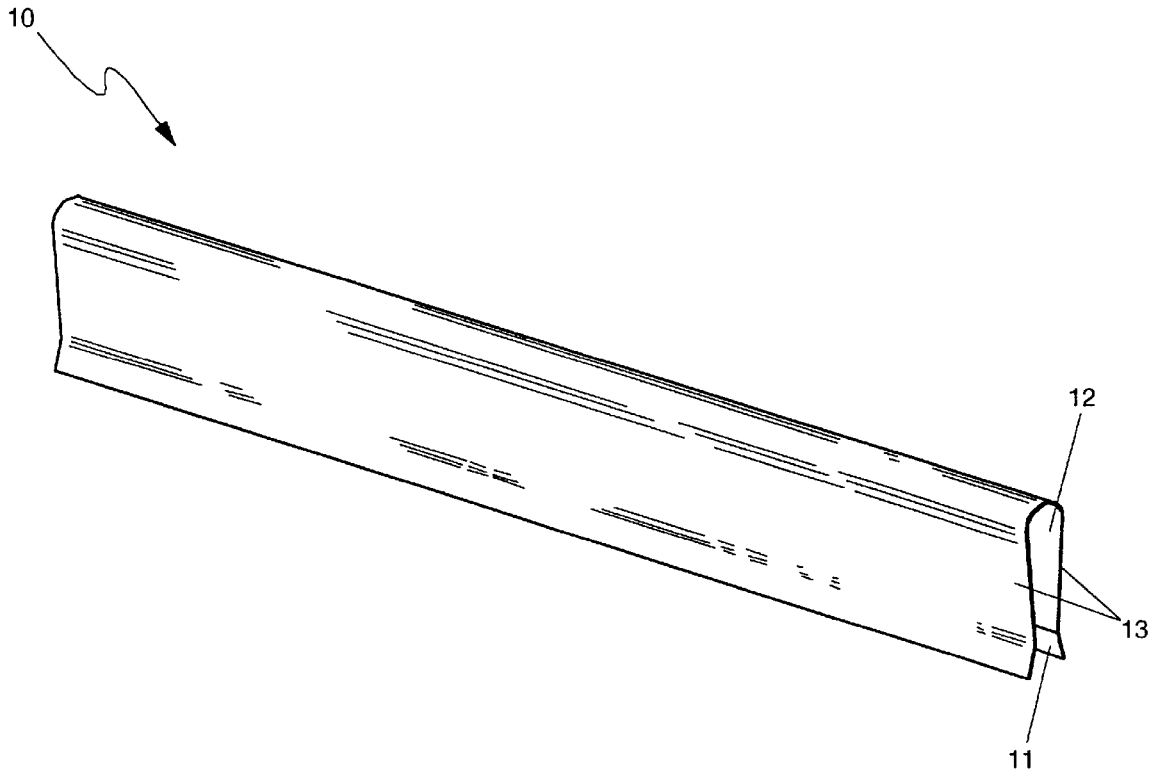
FIG. 1 is a perspective view of the concrete reinforcing bar impalement protection device, according to the preferred embodiment of the present invention.
Figure 2:
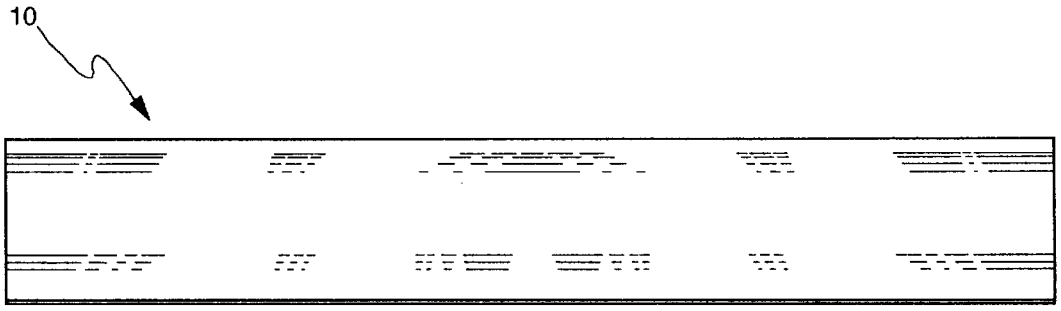
FIG. 2 is a side view of the concrete reinforcing bar impalement protection device, according to the preferred embodiment of the present invention.
Figure 3:
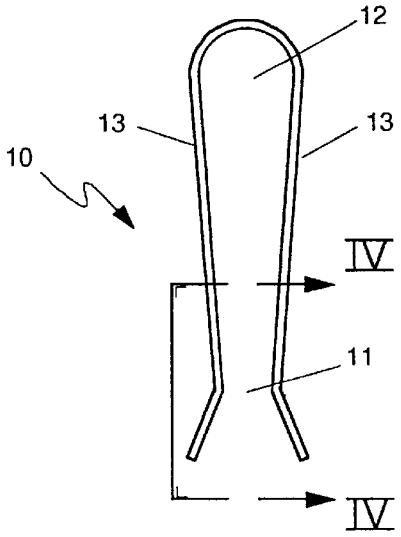
FIG. 3 is an end view of the concrete reinforcing bar impalement protection device, according to the preferred embodiment of the present invention.
Figure 4:
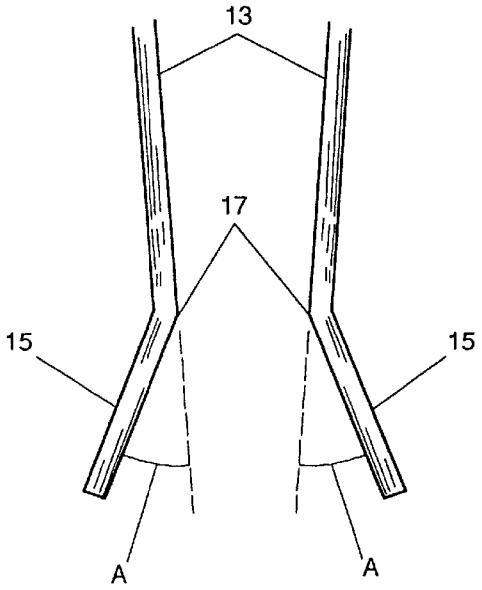
FIG. 4 is a exploded partial view of the concrete reinforcing bar impalement protection device taken along line IV—IV as depicted in FIG. 3, according to the preferred embodiment of the present invention.

Referring now to FIGS. 1–4, depicted is the concrete reinforcing bar impalement protection device, hereinafter impalement protector 10, according to the preferred embodiment of the present invention. The impalement protector consists of a elongated channel, constructed of a corrosion-resistant material such as stainless steel, galvanized steel, galvanized iron, aluminum or plastic, formed by bending a single piece of elongated rectangular material along the longitudinal axis thereof at various points thereon and to varying degrees. The profile of the impalement protector 10, when viewed from either end is generally U-shaped, forming an inserting edge 11 opposite a receiving edge 12 within two protector sidewalls 13. The general shape of the impalement protector 10, formed by the fold or bend at the receiving edge 12, is such that the protector sidewalls 13 converge towards one another as they extend from the receiving edge 12 toward the inserting edge 11. Bar-guiding flanges 15 are located at the ends of the protector sidewalls 13, at the inserting edge 11 of the impalement protector 10. The bar-guiding flanges 15 are angled acutely with respect to the linear direction of the protector sidewalls 13, at acute angle A, such that the bar-guiding flanges 15 are divergent with respect to one another, forming the concave structure of the inserting edge 11. The overall shape of the impalement protector 10 is such that they can be stacked easily upon one another, for transportation or storage, without requiring the use of containers or other special accommodations.

The converging orientation of the protector sidewalls 13, coupled with the diverging orientation of the bar-guiding flanges 15, forms reinforcing bar securing surfaces 17 on the interior surface of the protector sidewalls along the portion thereof that defines acute angle A. The distance that separates the bar securing surfaces 17 on the interior portion of the impalement protector 10 is generally smaller than the overall diameter of conventional concrete reinforcement bars (not shown), whereas the distance that separates the bar-guiding flanges 15 is substantially larger than the overall diameter of conventional concrete reinforcement bars. The resilient nature of the materials used to form the impalement protector 10, along with the work hardening resultant of the bending of the material along the receiving edge 12, creates a spring biasing that tends to maintain the relative position of the bar securing surfaces 17, drawing them together should they be drawn apart. Thus, the diverging nature of the bar-guiding flanges 15 allows the impalement protector 10 to easily be placed upon a concrete reinforcing bar as they serve to direct or guide the bar toward and through the inserting edge 11. As the concrete reinforcing bar enters and slides into the impalement protector 10, the bar securing surfaces 17 are spread apart against the aforementioned spring biasing that draws them together. As a result, the bar securing surfaces 17 create a friction fit with the concrete reinforcing bars, thus securing the impalement protector thereon. Installed upon the concrete reinforcing bars, the impalement protector 10 shields the tip of the bar, eliminating its exposure and thus preventing injuries associated with falling upon or otherwise coming into contact therewith.

2. Operation of the Preferred Embodiment

Figure 5:
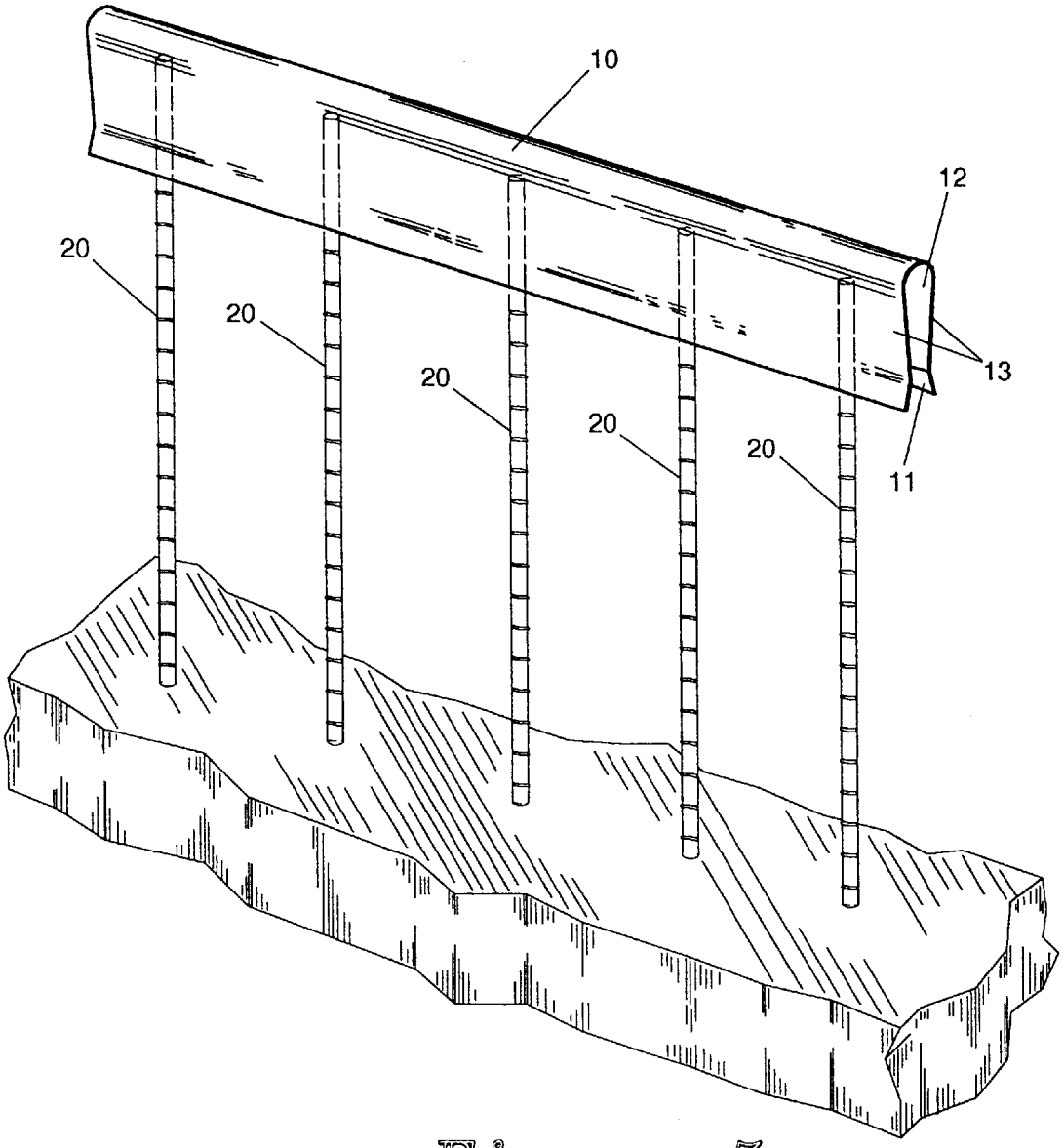
FIG. 5 is a perspective view of the concrete reinforcing bar impalement protection device, depicting its use in accordance with the preferred embodiment of the present invention.
Figure 6:
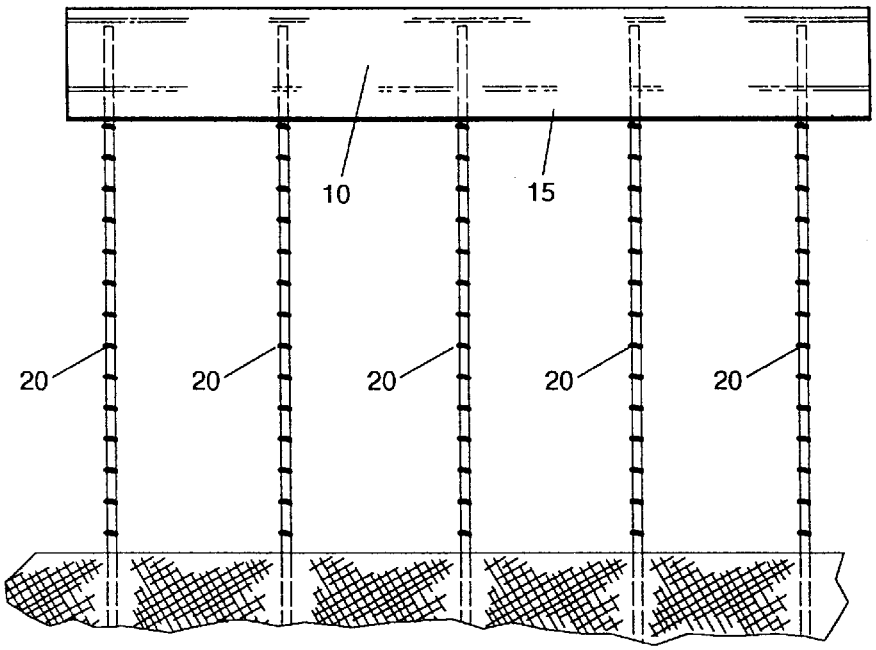
FIG. 6 is a side view of the concrete reinforcing bar impalement protection device, depicting its use in accordance with the preferred embodiment of the present invention.
Figure 7:
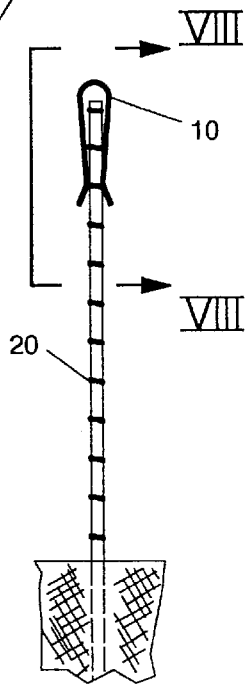
FIG. 7 is an end view of the concrete reinforcing bar impalement protection device, depicting its use in accordance with the preferred embodiment of the present invention.
Figure 8:
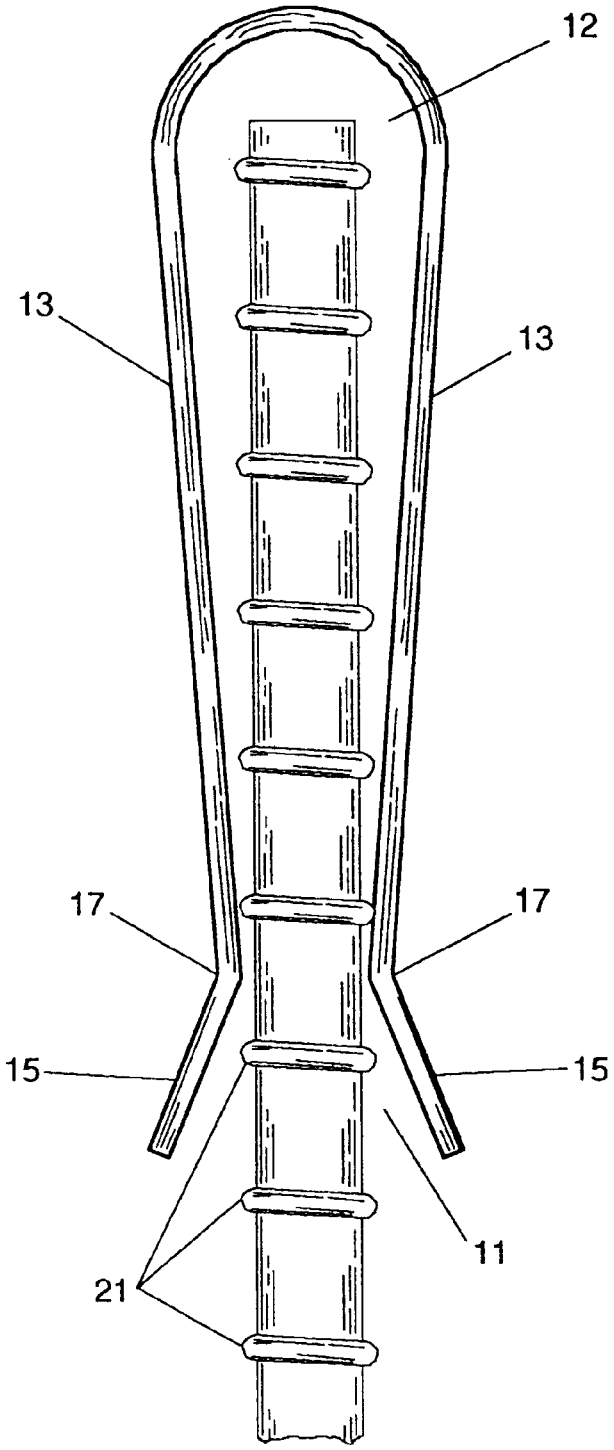
FIG. 8 is a exploded partial view of the concrete reinforcing bar impalement protection device taken along line VIII—VIII as depicted in FIG. 7, depicting its use in accordance with the preferred embodiment of the present invention.

Referring now to FIGS. 5–8, the impalement protector 10 is depicted in its use in accordance with the preferred embodiment of the present invention to prevent construction workers and others from falling onto or otherwise coming into contact with the protruding tips of concrete reinforcing bars 20.

The impalement protector 10 is slid over a protruding concrete reinforcing bar 20 by inserting the bar into the inserting edge 11 between the bar-guiding flanges 15. The angled nature of the bar-guiding flanges 15 creates a resultant force, when the concrete reinforcing bar 20 is inserted therein, that opens the gap between the bar securing surfaces 17, allowing the impalement protector 10 to slide over the bars. The impalement protector 10 is slid over the concrete reinforcement bar 20 until a position is reached wherein the bar is near or comes into contact with the receiving edge 12. Once installed over the concrete reinforcing bars 20, the impalement protector is held in place via a friction fit created between the bar and the bar securing surfaces 17, applied by the spring biasing created therebetween. The friction fit is aided by the presence of annular ridges 21, typically found on most conventional concrete reinforcing bars 20.

While the preferred embodiments of the invention have been shown, illustrated and described, it will be apparent to those skilled in this field that various modifications may be made in these embodiments without departing from the spirit of the present invention or the teachings of the present disclosure. It is for this reason that the scope of the invention is set forth in and is to be limited only by the following claims.

What is claimed is:

1. An impalement protector for use in shielding protruding concrete reinforcing bars, typically found on construction sites, in order to prevent personal injuries caused by falling or otherwise coming into contact with the tip of said concrete reinforcing bars, said impalement protector comprising:

an elongated channel having a generally U-shaped profile when viewed from either end, having a first sidewall opposite a second sidewall and having an open inserting edge opposite a closed receiving edge, said first sidewall and said second sidewall extending from said closed receiving edge in a convergent manner with respect to one another;

a first bar-guiding flange and a second bar-guiding flange located at the end of said first protector sidewall and said second protector sidewall, respectively, at said open inserting edge of said impalement protector, said first bar-guiding flange angled acutely with respect to the directional orientation of said first protector sidewall and said second bar-guiding flange angled acutely with respect to the directional orientation of said second protector sidewall such that said first bar-guiding flange and said second bar-guiding flange are divergent with respect to one another, forming a concave structure of said open inserting edge; and a first reinforcing bar securing surface opposite a second reinforcing bar securing surface formed on the interior surface of said elongated channel, said first reinforcing bar securing surface formed along said elongated channel in the area defining the acutely angled portion where said first protector sidewall meets said first bar-guiding flange, said second reinforcing bar securing surface formed along said elongated channel in the area defining the acutely angled portion where said second protector sidewall meets said second bar-guiding flange.

2. The impalement protector of claim 1, wherein said concave structure of said open inserting edge further comprises a guide by which, when inserted in said open inserting edge, one or more concrete reinforcing bars are directed between said first reinforcing bar securing surface and said second reinforcing bar securing surface, toward said closed receiving edge, said concave structure of said open inserting edge further defined by the distance between said first reinforcing bar securing surface and said second reinforcing bar securing surface being less than the diameter of conventional concrete reinforcing bars, between ¼ and 1 inches, and wherein the greatest distance between said first bar-guiding flange and said second bar-guiding flange is substantially larger than the diameter of conventional concrete reinforcement bars and not exceeding 4 inches.

3. The impalement protector of claim 1, wherein said impalement protector further comprises a single piece of elongated rectangular material, said material having a durable and non-corrosive quality and selected from the group comprising stainless steel, galvanized steel, galvanized iron, aluminum and plastic, said elongated rectangular material folded along its longitudinal axis at points and to degrees so as to form the contour of said U-shaped profile.

4. The impalement protector of claim 3, wherein the resilient nature of the materials used to form said impalement protector, along with any work hardening resultant of the bending of the material along said closed receiving edge creates a spring biasing that tends to maintain the position of said first bar securing surface relative to the position of said second bar securing surface, drawing them together in the event that they are forced apart and forming a friction fit wherein said spring biasing causes said first reinforcing bar securing surface and said second reinforcing bar securing surface to engage objects located therebetween with a lateral force.

* * * * *